US005622222A

United States Patent [19]

Wilson et al.

[11] Patent Number: 5,622,222

[45] Date of Patent: Apr. 22, 1997

[54] SCAVENGER SYSTEM AND ELECTRICAL SUBMERSIBLE PUMPS (ESP'S)

[75] Inventors: Brown L. Wilson, Tulsa; Leslie C. Reid, Coweta, both of Okla.; Paul M. Davis; Terrance P. Comeau, both of Calgary, Canada

[73] Assignee: Mobil Oil Corporation, Fairfax, Va.

[21] Appl. No.: 534,068

[22] Filed: Sep. 26, 1995

[51] Int. Cl.[6] ..... E21B 43/38

[52] U.S. Cl. ..... 166/105.4; 310/87

[58] Field of Search ..... 166/105.1, 105.4, 166/105.5, 386; 310/87, 89

[56] References Cited

U.S. PATENT DOCUMENTS

| | | | |
|---|---|---|---|
| Re. 32,866 | 2/1989 | Cruise . | |
| 1,546,973 | 7/1925 | Ellis | 166/105.4 X |
| 3,947,709 | 3/1976 | Waltman . | |
| 4,266,607 | 5/1981 | Halstead . | |
| 4,913,239 | 4/1990 | Bayh, III . | |
| 4,981,175 | 1/1991 | Powers | 166/105.5 X |
| 5,134,328 | 7/1992 | Johnatakis et al. . | |
| 5,309,998 | 5/1994 | Rivas et al. | 166/105.5 X |
| 5,367,214 | 11/1994 | Turner, Jr. . | |
| 5,403,476 | 4/1995 | Bernhardt | 166/105.5 X |
| 5,525,146 | 6/1996 | Straub | 166/105.5 |
| 5,553,669 | 9/1996 | Trainer | 166/105.1 |

*Primary Examiner*—Frank Tsay
*Attorney, Agent, or Firm*—Head, Johnson & Kachigian

[57] ABSTRACT

A submersible pumping unit for use in a corrosive environment. The submersible pumping unit has a housing which encases a motor and a pump. A scavenging material is located in the housing to prevent corrosive agents in the well fluid from making contact with the motor.

29 Claims, 4 Drawing Sheets

SCAVENGER SYSTEM AND ELECTRICAL SUBMERSIBLE PUMPS (ESP'S)

BACKGROUND OF THE INVENTION

1. Field of the Invention

The present invention relates to submersible pumps, and more particularly relates to a submersible pump employing a scavenger system to protect the pump motor from corrosive agents present in the well fluid.

2. Background

The fluid in many producing oil and/or gas wells is elevated to the surface of the ground by the action of a pumping unit or a pumping apparatus installed in the lower portion of the well bore. In recent times there has been increased activity in the drilling of well bores to great depths. In addition, the use of water flooding for additional fluid recovery in oil fields, wherein the production of the subsurface fluid has been somewhat depleted, is commonly practiced. This water flooding has produced a considerable quantity of downhole fluid in the well bore. As a result it has become necessary to install downhole pumps within the fluid contained within the well bore.

Electrical submersible pumps (ESPs) are used for lifting fluid from bore holes. In operation, an electrical submersible pump's motor and pump are placed below the fluid surface in the bore hole. The well fluid often contains corrosive compounds such as brine water, $CO_2$, and $H_2S$ that can shorten the run life of an ESP since the ESPs are directly exposed to the well fluid. Attempts to solve the problem of corrosion include the development of corrosion resistant units. The motors in these corrosion resistant units generally use seals and barriers to exclude the corrosive agents from the internal mechanisms of the ESP.

Electrical submersible pump motors have special problems that make the motors difficult to protect from corrosion. For example, the motor is filled with fluid, typically a dielectric oil, for lubrication and cooling. As the motor operates, the oil heats up and expands. When the unit is shut off, the fluid cools and contracts. This expanding and contracting, or "breathing", of the motor fluid makes it necessary to provide an expansion mechanism to accommodate the heated fluid. This expansion mechanism usually uses baffles creating tortuous flow path for the oil or a barrier that is either an elastomeric bladder or a direct interface between the well fluid and the motor fluid. A problem is that corrosive agents can cross the tortuous flow path or cross or penetrate the barrier and attack the internal components of the motor. The design of an electric motor for a submersible pump requires the use of copper for the magnetic coils and other metals and materials that can be corroded or degraded by the presence of corrosive compounds. This phenomena becomes severe in higher temperature wells.

SUMMARY OF THE INVENTION

It is therefore an object of the invention to provide an electrical submersible pump having a scavenger material located in the path of corrosive agents that could come in contact with the pump motor or with the fluid system of the motor. The scavenger material will either block, absorb, or unite with the corrosive agents and prevent contact between the corrosive agents and the pump motor or fluid system of the motor.

The present invention contemplates locating a scavenger material to prevent corrosive agents from making contact with the motor of an electrical submersible pump or with the fluid system of such a motor. General construction of an ESP uses a motor on the bottom and a pump on top. Between these sections is the protective structure that provides a location for four necessary functions. First, a shaft seal must be utilized to prevent the well fluid from entering the pumping unit down the rotating shaft of the ESP. Second, an equalizing element must be present to balance the internal pressure of the motor with that of the well bore. Third, an expansion chamber must be provided to act as a reservoir to contain the expanded motor oil when the oil is heated by the running pump motor. Additionally, the expansion chamber serves to return the oil to the motor as the oil cools and contracts after the motor is shut down. Fourth, a thrust bearing must be present to absorb the thrust generated by the pump. In the preferred embodiment, a scavenger material is located between two expansion chambers. When the pump motor becomes hot and the motor fluid heats and expands, the motor fluid migrates up into a first expansion chamber. Preferably, the expansion chamber is equipped with an expansion bag, or elastomeric bladder. This expansion bag provides an additional barrier to corrosive agents. As the motor fluid continues to expand, and the expansion bag becomes full, the motor fluid is then forced through a check valve and up into a scavenger chamber. In the scavenger chamber, the oil is forced through a scavenger material as it migrates upward to a second expansion chamber preferably equipped with a second expansion bag, or elastomeric bladder. This second expansion chamber is open to the well bore. Therefore, the second expansion chamber contains well fluid on the outside of the expansion bag and motor fluid on the inside of the expansion bag. However, corrosive agents, such as hydrogen sulfide, are known to pass through the bag and migrate through the motor fluid to the pump motor. These corrosive agents will cause damage to the motor. In the present invention, however, the corrosive agents must pass through the scavenger chamber before making contact with the pump motor. Scavenger material in the scavenger chamber will minimize or eliminate the corrosive agents that may come in contact with the pump motor by blocking, absorbing, or uniting with the corrosive agents.

DETAILED DESCRIPTION OF THE PREFERRED EMBODIMENTS

Figure 1:
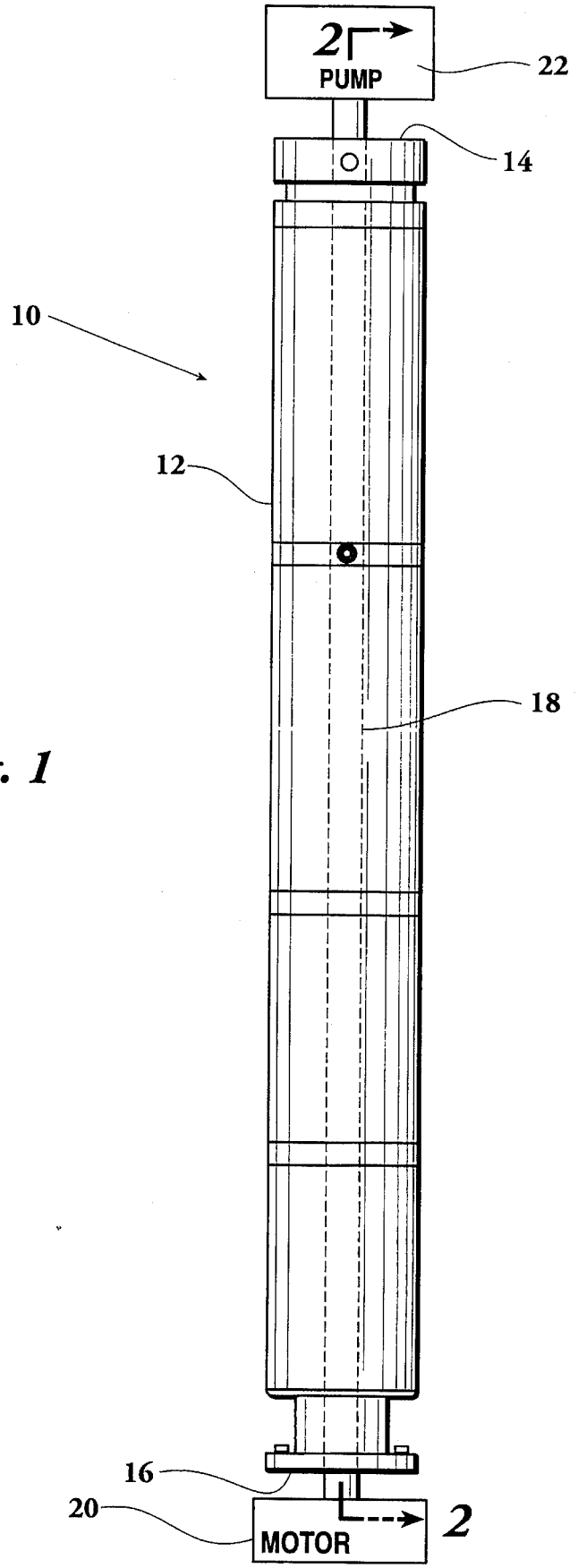
FIG. 1 is a partial schematic view of an electrical submersible pump with an elevational view of the seal section.
Figure 2A:
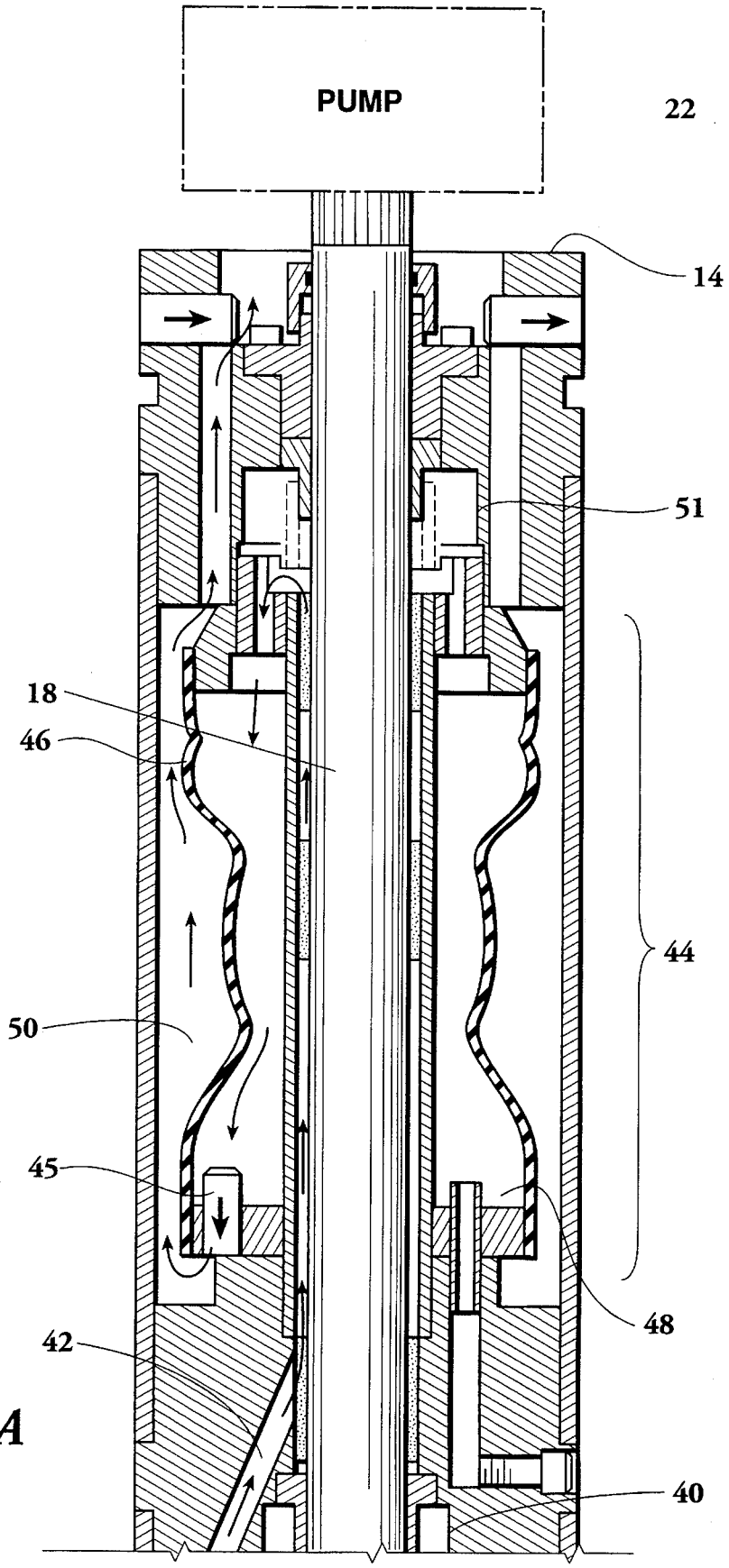
FIG. 2*a* is a cross-sectional view of an upper portion of the seal section.
Figure 2B:
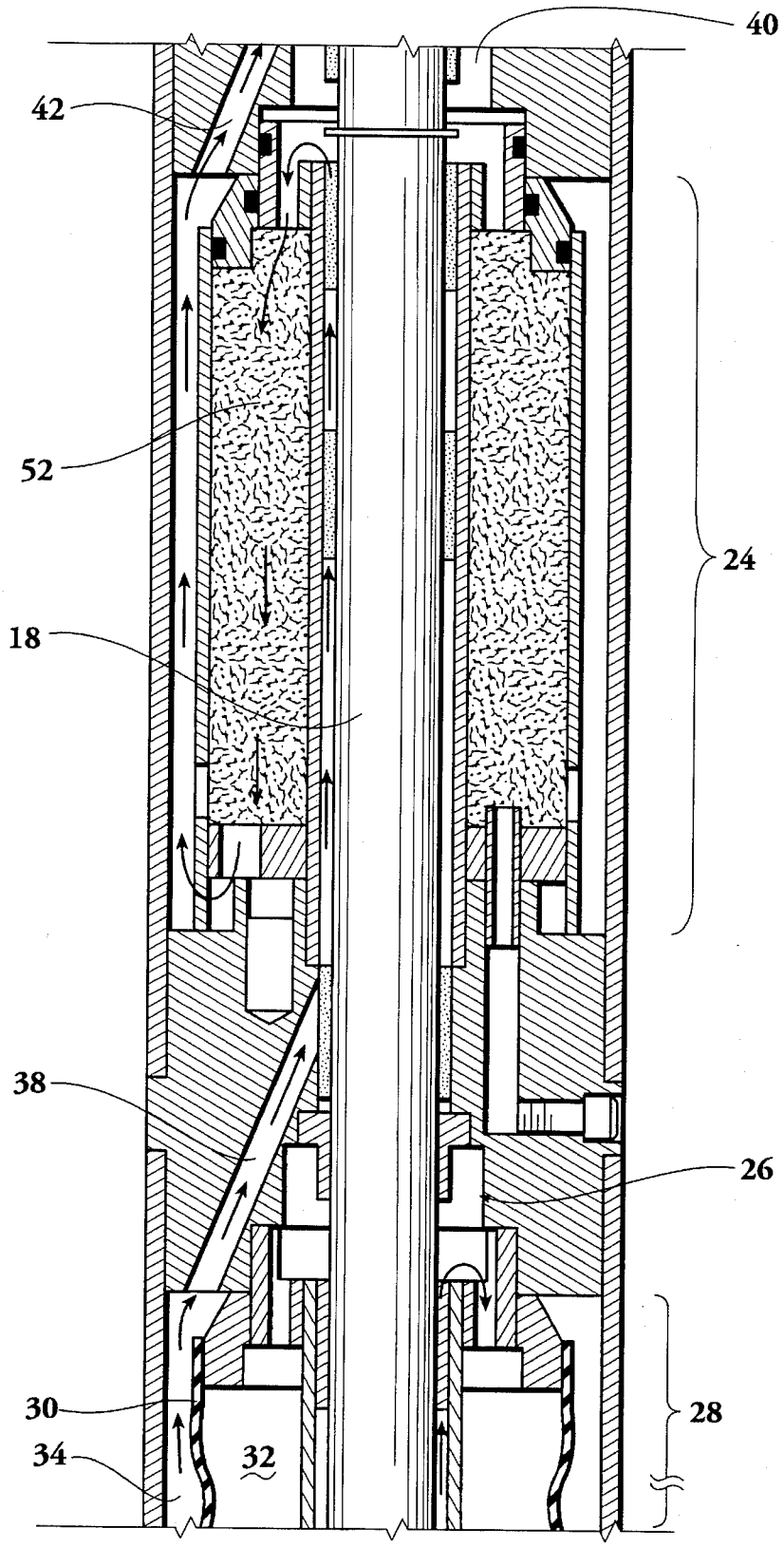
FIG. 2*b* is cross-sectional view of a middle portion of the seal section.
Figure 2C:
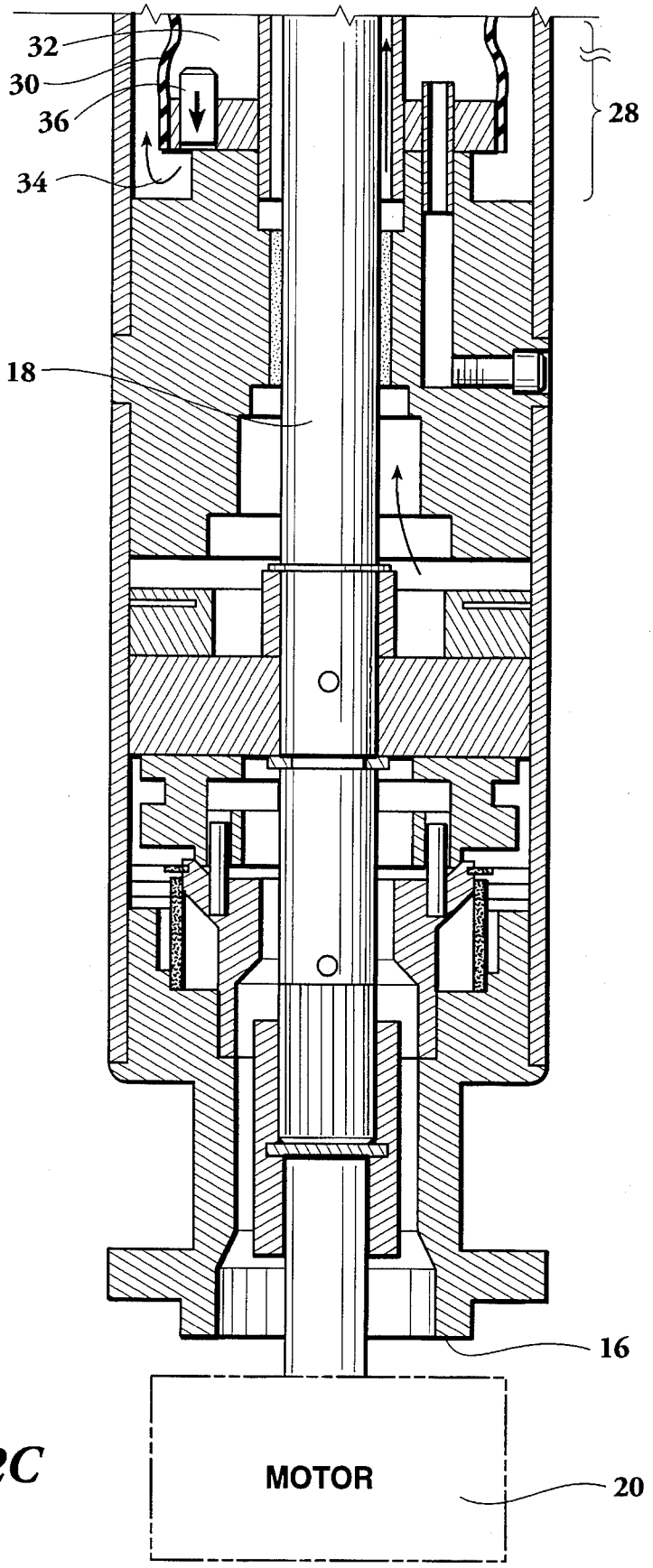
FIG. 2*c* is a cross-sectional view of a lower portion of the seal section.

Referring to FIG. 1, the seal section of a submersible pumping unit is designated generally 10. Seal section 10 is encased in cylindrical housing 12. The housing 12 has an upper end 14 and a lower end 16. A shaft 18 is driven by motor 20. The shaft extends interiorly of housing 12 and drives pump 22. Located in housing 12 and positioned between motor 20 and pump 22, is scavenger chamber 24 as shown in FIG. 2*b*. As can be seen in FIG. 2*b* and 2*c*, first shaft seal 26 is positioned between motor 20 and scavenger chamber 24. First expansion chamber 28 is located between first shaft seal 26 and motor 20. First elastomeric bladder 30 is located in first expansion chamber 28. First elastomeric bladder 30 defines a motor fluid encasing volume 32 and an overflow motor fluid encasing volume 34. A first check valve 36 communicates with the motor fluid encasing volume 32 of first expansion chamber 28 and the overflow motor fluid encasing volume 34. A first passageway 38 is located proximate to first shaft seal 26 and communicates with overflow motor fluid encasing volume 34 and scavenger chamber 24. A second shaft seal 40 is positioned between second expansion chamber 44 and scavenger chamber 24. A second passageway 42 is located proximate to said second shaft seal 40 communicates with scavenger chamber 24 and second expansion chamber 44. Second elastomeric bladder 46 is present in second expansion chamber 44 as can be seen in FIG. 2*a*. Second elastomeric bladder 46 defines a second overflow motor fluid encasing volume 48 and a well fluid encasing volume 50. Third shaft seal 51 is located between pump 22 and second expansion chamber 44. Scavenger material 52 is located in scavenger chamber 24.

In operation, shaft 18 is driven by motor 20 and drives pump 22. Motor 20 generates heat during operation. This heat warms the motor fluid. As the motor fluid becomes hot, the motor fluid expands. The path taken by the expanded motor fluid is indicated by arrows in FIG. 2(*a*)–(*c*). Initially, the motor fluid migrates into first expansion chamber 28 where it fills a first elastomeric bladder 30. When elastomeric bladder 30 becomes full, the motor fluid migrates through a first check valve 36, out of the motor fluid encasing volume 32 and into the overflow motor fluid encasing volume 34. The motor fluid is prevented from migrating up shaft 18 by first shaft seal 26. Instead, the motor fluid is directed through first passageway 38 and into scavenger chamber 24. By expanding further, the motor fluid is then forced through scavenger material 52 where any corrosive agents are blocked or absorbed by scavenger material 52 or are united with scavenger material 52 in a reaction that creates non-corrosive products. Similarly, the expanding motor fluid is directed through second passageway 42 by second shaft seal 40. Second passageway 42 is provided to allow the motor fluid to migrate from scavenger chamber 24 to second elastomeric bladder 46 located in second expansion chamber 44. When second elastomeric bladder 46 becomes full of heated motor fluid, the motor fluid passes through check valve 45 where it mixes with the well fluid. Second elastomeric bladder 46 functions as a barrier between the overflow motor fluid and the well fluid. Third shaft seal 51 prevents well fluid from traveling along shaft 18 into second motor fluid encasing volume 48. Third shaft seal 51 additionally ensures that motor fluid does not escape second expansion chamber 44 by migrating along shaft 18.

Even though second elastomeric bladder 46 and first elastomeric bladder 30 are employed as barriers, corrosive agents can pass through these materials. These corrosive agents then migrate through second passageway 42 and into scavenger chamber 24 where the corrosive agents come in contact with scavenger material 52. Scavenger material 52 blocks, absorbs, or reacts with the corrosive agents, thereby preventing the corrosive agents from making contact with and corroding motor 20. Scavenger material 52 preferably comprises a di-valent transition element or elements, or an oxide of a di-valent transition element or elements. Zinc oxide pellets are preferred although other material may be used, examples of which are iron oxide, copper and tin or materials containing iron oxide, copper, and tin. The presence of scavenger material 52 in scavenger chamber 24 thereby preserves motor 20 and increases the operable service life of submersible pumping unit.

Whereas, the present invention has been described in relation to the drawings attached hereto, it should be understood that other and further modifications, apart from those shown or suggested herein, may be made within the spirit and scope of this invention.

What is claimed is:

1. A submersible pump for use in a corrosive environment, comprising:

a housing having a first end and a second end;

a motor, said motor located inside said housing and positioned near said first end of said housing, said motor substantially filled with a motor fluid;

a shaft having a first and a second end and extending interiorly of said housing, said first end of said shaft attached to said motor;

a pump, said pump located inside said housing and located near said second end of said housing, said pump affixed to said second end of said shaft; and said housing including a scavenger chamber having a scavenger material therein, said chamber located for communication with said motor fluid.

2. A submersible pump according to claim 1 wherein said scavenger chamber having a scavenger material therein is located between said motor and said pump.

3. A submersible pump according to claim 1 further comprising a shaft seal around said shaft to prevent well fluid from migrating along said shaft.

4. A submersible pump according to claim 1 further comprising an expansion chamber that acts as a reservoir to contain expanded motor fluid and return motor fluid to said motor after said motor fluid contracts, said expansion chamber located between said motor and said pump.

5. A submersible pump according to claim 4 wherein said expansion chamber is located between said scavenger chamber and said pump.

6. A submersible pump according to claim 4 wherein said expansion chamber is located between said scavenger chamber and said motor.

7. A submersible pump according to claim 1 further comprising a plurality of expansion chambers that act as reservoirs to contain expanded motor fluid and return motor fluid to said motor after said motor fluid contracts, said expansion chambers located between said motor and said pump.

8. A submersible pump according to claim 7 wherein an expansion chamber is located between said scavenger chamber and said pump and an expansion chamber is located between said scavenger chamber and said motor.

9. A submersible pump according to claim 1 wherein said scavenger material blocks corrosive agents.

10. A submersible pump according to claim 1 wherein said scavenger material absorbs corrosive agents.

11. A submersible pump according to claim 1 wherein said scavenger material reacts with corrosive agents in said motor fluid to create non-corrosive products.

12. A submersible pump according to claim 1 wherein said scavenger material is comprised of a di-valent transition element.

13. A submersible pump according to claim 12 wherein said scavenger material is copper.

14. A submersible pump according to claim 1 wherein said scavenger material is comprised of an oxide of a di-valent transition element.

15. A submersible pump according to claim 14 wherein said scavenger material is zinc oxide.

16. A submersible pump according to claim 14 wherein said scavenger material is iron oxide.

17. A submersible pump according to claim 1 wherein said scavenger material is comprised of an alloy of di-valent transition elements.

18. A submersible pump according to claim 17 wherein said scavenger material is bronze.

19. An electric submersible pump for use in corrosive well fluid comprising:

an elongated housing having a first and a second end;

a motor located in said housing and proximate to said first end of said housing;

a shaft located in said housing having a first and a second end, said first end of said shaft affixed to said motor;

a pump located in said housing and proximate to said second end of said housing, said pump affixed to said second end of said shaft;

a scavenger chamber located in said housing and positioned between said pump and said motor, said scavenger chamber for receiving a scavenger material;

a first shaft seal positioned between said motor and said scavenger chamber, said first shaft seal to prevent motor fluid from migrating along said shaft;

a first expansion chamber located between said first shaft seal and said motor for receiving motor fluid;

a first elastomeric bladder in said first expansion chamber defining a motor fluid encasing volume and an overflow motor fluid encasing volume said first elastomeric bladder to function as a barrier between said motor fluid encasing volume and said overflow motor fluid encasing volume;

a first check valve communicating with said motor fluid encasing volume and said overflow motor fluid encasing volume to permit motor fluid to migrate from said motor fluid encasing volume to said overflow motor fluid encasing volume;

a first passageway positioned proximate said first shaft seal, said first passageway for providing a passage for motor fluid to migrate, said first passageway extending from said first overflow motor fluid encasing volume of said first expansion chamber to said scavenger chamber;

a second expansion chamber located between said scavenger chamber and said pump, said second expansion chamber for receiving motor fluid;

a second elastomeric bladder in said second expansion chamber to function as a barrier between motor fluid and said well fluid, said second elastomeric bladder defining a second overflow motor fluid encasing volume and a well fluid encasing volume;

a second shaft seal positioned between said second expansion chamber and said scavenger chamber, said second shaft seal to prevent fluids from migrating along said shaft;

a second passageway positioned proximate said second shaft seal, said second passageway for providing a passage for motor fluid to migrate, said second passageway extending from said scavenger chamber to said second overflow motor fluid encasing volume;

a third shaft seal positioned between said second expansion chamber and said pump to prevent fluids from migrating along said shaft; and a second check valve communicating with said second overflow motor fluid encasing volume and said well fluid encasing volume to permit motor fluid to migrate from said second motor fluid encasing volume to said well fluid encasing volume.

20. An electric submersible pump according to claim 19 further comprising a scavenger material located in said scavenger chamber.

21. An electric submersible pump according to claim 19 wherein said scavenger material is comprised of a di-valent transition element.

22. An electric submersible pump according to claim 19 wherein said scavenger material is comprised of an oxide of a di-valent transition element.

23. An electric submersible pump according to claim 19 wherein said scavenger material is comprised of an alloy of a di-valent transition element.

24. An electric submersible pump for use in corrosive well fluid comprising:

an elongated housing having a first and second end;

a motor that is cooled by motor fluid, said motor located in said housing and proximate to said first end of said housing;

motor fluid surrounding said motor;

a shaft located in said housing having a first and a second end, said first end of said shaft affixed to said motor;

a pump located in said housing and proximate to said second end of said shaft, said pump affixed to said second end of said shaft;

a scavenger chamber located in said housing and positioned between said pump and said motor, said scavenger chamber for receiving a scavenger material.

25. An electric submersible pump according to claim 24 further comprising an expansion chamber located between said motor and said pump.

26. An electric submersible pump according to claim 24 further comprising a scavenger material.

27. An electric submersible pump according to claim 26 wherein said scavenger material is comprised of a di-valent transition element.

28. An electric submersible pump according to claim 26 wherein said scavenger material is comprised of an oxide of a di-valent transition element.

29. An electric submersible pump according to claim 26 wherein said scavenger material is comprised of an alloy of a di-valent transition element.

* * * * *

UNITED STATES PATENT AND TRADEMARK OFFICE

CERTIFICATE OF CORRECTION

PATENT NO. : 5,622,222

DATED : April 22, 1997

INVENTOR(S) : Brown L. Wilson et al.

It is certified that error appears in the above-identified patent and that said Letters Patent are hereby corrected as shown below:

"Cover page, [73] Assignee: --Oil Dynamics, Inc., Tulsa, Oklahoma-- be inserted before "Mobil Oil Corporation, Fairfax, VA".

Signed and Sealed this

Thirtieth Day of September, 1997

*Attest:*

Bruce Lehman

BRUCE LEHMAN

*Attesting Officer*

*Commissioner of Patents and Trademarks*